US007517180B2

(12) United States Patent
Baker

(10) Patent No.: US 7,517,180 B2
(45) Date of Patent: Apr. 14, 2009

(54) MOBILE PALLET WITH VARIOUS LOCKING MEANS

(76) Inventor: Maurice Baker, 14 Forest Lodge Close, Riddells Creek, Victoria 3431 (AU)

( * ) Notice: Subject to any disclaimer, the term of this patent is extended or adjusted under 35 U.S.C. 154(b) by 229 days.

(21) Appl. No.: 10/534,555

(22) PCT Filed: Oct. 14, 2003

(86) PCT No.: PCT/AU03/01355

§ 371 (c)(1),
(2), (4) Date: Jun. 27, 2005

(87) PCT Pub. No.: WO2004/045988

PCT Pub. Date: Jun. 3, 2004

(65) Prior Publication Data

US 2005/0252423 A1 Nov. 17, 2005

(30) Foreign Application Priority Data

Nov. 18, 2002 (AU) ..... 2002952755
Apr. 28, 2003 (AU) ..... 2003901994

(51) Int. Cl.
*B60P 7/08* (2006.01)

(52) U.S. Cl. ..... 410/66; 410/46; 410/84

(58) Field of Classification Search ..... 410/66–67, 410/46, 84, 130, 150; 414/498; 206/386; 108/55.1, 56.1, 57.15; 220/1.5; 244/118.1, 244/137.1

See application file for complete search history.

(56) References Cited

U.S. PATENT DOCUMENTS 3,456,826 A * 7/1969 Pavlik
4,976,365 A 12/1990 Seo
7,118,314 B2 * 10/2006 Zhou et al. ..... 410/84

FOREIGN PATENT DOCUMENTS

DE 32 46 347 A1 6/1984
WO WO 02/090199 A1 11/2002

* cited by examiner

*Primary Examiner*—Stephen Gordon
(74) *Attorney, Agent, or Firm*—Edwin D. Schindler

(57) ABSTRACT

A pallet for use with a freight container includes a chassis having a leading edge, a trailing edge opposite the leading edge and a plurality of sides between the leading edge and the trailing edge, along with a locomotion device for rolling the chassis into, and out of, the freight container. A locking device is provided at two sides of, and located at, either the leading edge or the trailing edge of the pallet for immobilizing the chassis within the freight container with the locking device able to be engaged with a container wall, or another, adjacent pallet, to one side of the plurality of sides of the initial pallet for use with the freight container. The locking device is further able to engage a container wall, or the adjacent pallet, to the leading edge or the trialing edge of the initial pallet for preventing movement in mutually perpendicular directions in a horizontal plane.

20 Claims, 1 Drawing Sheet

MOBILE PALLET WITH VARIOUS LOCKING MEANS

AREA OF THE INVENTION

This invention relates to the area of sea freight containers, and in particular to pallets for use inside such containers, and a locking mechanism to maintain the pallets in a fixed location within a sea freight container.

BACKGROUND TO THE INVENTION

It is well known for goods which are transported in sea freight containers to be loaded on pallets for ease of handling.

In recent times pallets have been developed of a type which are able to be rolled into and out of such a container. This mobile nature of such pallets can however cause difficulties in relation to their movement within a container when the container is either being moved for transport or, in particular, when the container is on a ship at sea.

Quite clearly a container which is on a ship is subject to a significant degree of movement and so are containers when they are being loaded and unloaded and being transported. Therefore any device, such as a pallet, which is inside the container and which is not securely fixed in a particular position in relation to the container is going to move. This in turn may contribute to problems associated with damage to goods which are being transported on the pallet and, in an extreme event, to damage to the container itself.

OUTLINE OF THE INVENTION

It is an object of this invention to provide a locking means for a mobile pallet for use inside a sea freight container.

The invention is a pallet for use with a sea freight container said pallet having a chassis which is provided with locomotion means enabling it to be rolled into and out of the container and also with locking means to immobilise it within the container.

It is preferred that the locomotion means be a plurality of rollers however wheels or other appropriate means could be used. It is further preferred that the pallet have an upper surface positioned on the chassis which surface is provided with an aperture over the location of any roller such that pallets of the same size are able to be stacked one upon the other.

It is preferred also that the locking means consists of a plurality of locking means adapted to function at different locations on the chassis.

A first locking mechanism is positioned at either side of the leading edge of the pallet when it enters the container. This mechanism is a device pivotally mounted about an axial member on the chassis such that the device is generally parallel to the container side walls as the pallet moves into or out of the container. As the leading edge of the pallet approaches the interior rear wall of the container it is able to rotate outwardly from the chassis and to engage with the side walls of the container. It is preferred that the pivotally mounted device is a roller device. It is however envisaged that any appropriate mounting could be used or any engagement means for the device.

A second locking means is associated with the trailing edge of the pallet chassis. This locking means consists of a body member on either side of the rear of the pallet, said body housing a screw member which can be screwed out to engage with a side wall of the container. It is preferred that a locking nut be provided to screw up to the body thereby preventing unlocking of this mechanism.

A third locking means is positioned generally centrally on the trailing edge of the pallet chassis. This locking means is an extensible member able to be moved into close abutment with one or more rear doors of a container and held there preferably by means of a ratchet and pawl arrangement In order that the invention may be more readily understood a specific embodiment of the invention will be described by way of non-limiting example with reference to the following drawings.

BRIEF DESCRIPTION OF THE DRAWING FIGURES

DESCRIPTION OF A PREFERRED EMBODIMENT OF THE INVENTION

Figures 1, 2, 3, 4:
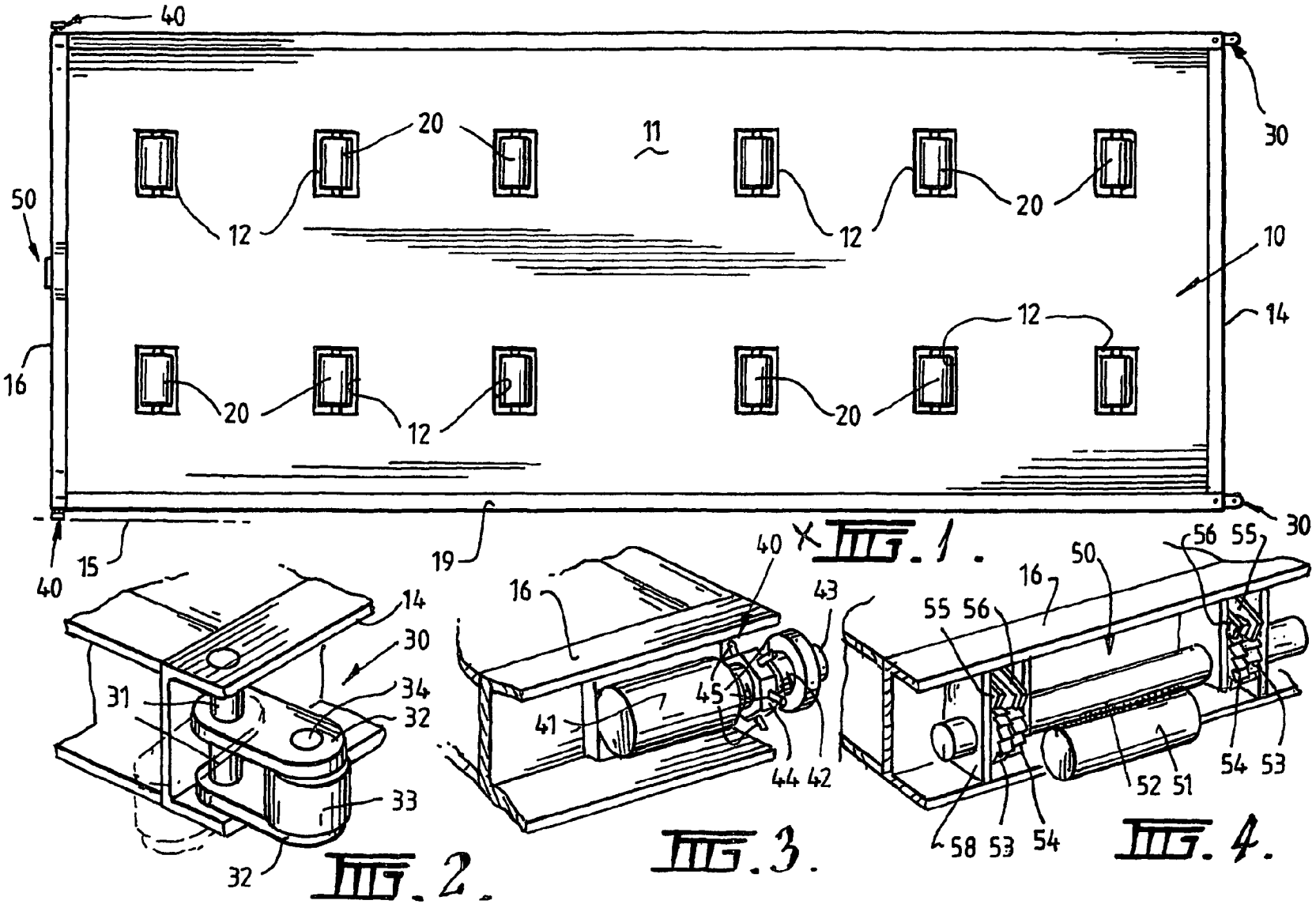
FIG. 1 shows a schematic view of the pallet of this invention.
FIG. 2 is a perspective view of an embodiment of the pallet leading edge locking mechanism.
FIG. 3 is a perspective view of an embodiment of a side locking mechanism at the trailing edge of a pallet.
FIG. 4 is a diagrammatic representation of an embodiment of a means for locating the trailing edge of a pallet in close abutment with container doors.

In a preferred embodiment of the invention (as shown in FIG. 1) a pallet 10 for a sea freight container is provided which has locomotion means in the form of wheels or rollers 20 and locking means to retain it in a fixed relation to the container interior.

The pallet has an upper surface 11 positioned on the chassis 19 which surface is provided with an aperture 12 over the location of any roller such that pallets of the same size are able to be stacked one upon the other.

It is preferred also that the locking means consists of a plurality of locking means adapted to function at different locations on the chassis.

A first locking mechanism 30 (FIG. 2) is positioned at either side of the leading edge 14 of the pallet when it enters the container. This mechanism 30 is a device pivotally mounted about an axial member 31 mounted on the chassis of the pallet.

In this embodiment of the invention the leading edge 14 and the trailing edge 16 of the pallet are formed from a channel shaped extrusion and axial members 31 are mounted adjacent corners of the leading edge of the pallet between opposing channel faces.

The locking member 30 consists of two parallel faces 32 pivotingly connected to 31 and separated by a member 34 about which a roller 33 can rotate. The arrangement is such that the device 30 is generally parallel to the container side walls 15 as the pallet moves into or out of the container. As the leading edge of the pallet approaches the interior rear wall of the container device 30 is able to rotate outwardly from the chassis and to engage with the side walls of the container.

It is preferred that the pivotally mounted device is a roller device. It is however envisaged that any appropriate mounting could be used or any engagement means for the device.

A second locking means 40 is associated with the trailing edge 16 of the pallet chassis. This locking means 40 consists of a body member 41 welded in side the trailing edge channel on either side of the rear of the pallet, said body member housing a screw member 42 which can be screwed out such that an end 43 thereof engages with a side wall of the container.

When the end 43 is engaged it is preferred that a locking screw 44 with lugs 45 be provided to screw up to the body member 41 thereby preventing unlocking of this mechanism.

A third locking means 50 is positioned generally centrally inside the channel on the trailing edge 16 of the pallet chassis. This locking means has an extensible member 51 able to be moved into close abutment with one or more rear doors of the container.

Member 51 is welded to a rod 52 which is able to rotate through support members 58. Member 51 is positioned between and closely adjacent to twin ratchets 53 and 54 engaging with pawls 55 and 56 respectively. The teeth of these pawls are offset relative to one and other to provide for fine adjustment of member 51 when it is rotated outwards from trailing edge 16.

Locking member 50 is used to positively engage the trailing edge of a pallet with the rear doors of a container. In practice one container door can be closed and the member 51 is rotated out to closely abut that door, after which time the other door can be closed. The ratchet pawl arrangement can be easily released once the doors are reopened.

Locking member 30 acts to automatically located the pallet leading edge corners inside a container. This location is not a positive locking mechanism however and release is automatic when the pallet is withdrawn from the container. The advantage of this device is that access to the interior of the container is not required to effect this release.

It is preferred that locking members 30 be used on all pallets and that either or both of locking members 40 and 50 be used to positively locate a pallet in position within a container. In particular locking member 50 can be used to fill any space left when one or more pallets are loaded into a single container.

Apart from the general requirements as to strength which would be self evident any appropriate materials can be used for the construction of the components of these locking mechanisms. In a preferred embodiment of the invention presumably these would be generally manufactured from strong metal products however the material of the rollers could be of some shock absorbing nature if that was desired.

The invention therefore provides a pallet which can be loaded and unloaded outside a sea freight container and then be rolled by a fork lift or the like into and out of such a container. The provision of the locking mechanisms used in association with the pallet means that produce of all kinds can be securely transported on the pallet without risk of damage during travel. Pallet loading can also be extremely secure in that loading and unloading can be effected outside a sea freight container.

Whilst one particular embodiment of the invention has been described herein it is to be understood that variations and modifications in the features described and the materials used can still lie within the scope of the invention.

The claim defining the invention are as follows:

1. A pallet for use with a freight container, comprising:

a chassis having a leading edge, a trailing edge opposite the leading edge and two opposite sides between the leading edge and the trailing edge;

locomotion means for rolling said chassis into, and out of, a freight container; and, locking means located at the two opposite sides and located at either the leading edge or the trailing edge, said locking means including a mechanism on either the leading edge or the trailing edge having an extensible member fixedly extendable at increments from a retracted position to a variable extended position, wherein said locking means immobilize said chassis within the freight container, by engaging with a vertical container wall, or an adjacent pallet.

2. The pallet for use with a freight container according to claim 1, wherein said locking means includes at least one roller mounted on each opposite side of the two opposite sides of said chassis.

3. The pallet for use with a freight container according to claim 1, further comprising a locking arrangement positioned at, or towards, two ends of the leading edge or the trailing edge said locking arrangement being pivotally mounted about a substantially vertical axial member on said chassis, so that said locking arrangement is rotatable outwardly from said chassis for engaging with a vertical wall of the freight container or an adjacent pallet.

4. The pallet for use with a freight container according to claim 3, wherein said locking arrangement includes two parallel faces pivotally connected adjacent one end to said axial member and separated by a container wall engaging member.

5. The pallet for use with a freight container according to claim 4, wherein the container wall engaging member is an additional axial member located between said two parallel faces about which a roller member is rotatable.

6. The pallet for use with a freight container according to claim 1, wherein said locking means includes a locking device located on each opposite side of the two opposite sides of said chassis and existing corners of the trailing edge, said locking device being movable between a retracted position and an extended position for being engagable with a side wall of the freight container or an adjacent pallet.

7. The pallet for use with a freight container according to claim 6, wherein said locking device includes a body member welded to the chassis, said body member housing a screw member screwable outwardly, so that an outer extremity thereof engages a side wall of the freight container.

8. The pallet for use with a freight container according to claim 7, wherein said screw member is engagable with a wall of the freight container via a locking nut mounted on said screw member.

9. The pallet for use with a freight container according to claim 1, wherein said mechanism of said locking means is located substantially centrally on said trailing edge of said chassis to extend from said trailing edge and abut a door of the freight container.

10. The pallet for use with a freight container according to claim 1, further comprising a horizontal rod to which said extensible member is connected, said horizontal rod being rotatable between support members located on said trailing edge, said horizontal rod having at least one ratchet member engagable with a pawl, so that said extensible member is fixedly rotatable out from said trailing edge or said leading edge.

11. The pallet for use with a freight container according to claim 10, wherein said at least one ratchet member comprises offset twin ratchets on said horizontal rod, each of said offset twin ratchets having a respective pawl, closely adjacent opposite ends of said extensible member.

12. The pallet for use with a freight container according to claim 1, wherein said locking means includes at least one locking device located at, or in close proximity to, a corner of said chassis.

13. A pallet for use with a freight container, comprising:

a chassis;

locomotion means for rolling said chassis into, and out of, a freight container; and, locking means for immobilizing said chassis within the freight container and being positioned at a side of a leading edge of said pallet when said pallet enters the freight container, said locking means being pivotally mounted about an axial member on said chassis, so that said locking means is substantially parallel to side walls of the freight container as said pallet moves into, and out of, the freight container, but said locking means is rotatable outwardly from said chassis for engaging with the side walls of the freight container when said locking means contacts an interior rear wall of the freight container.

14. The pallet for use with a freight container according to claim 13, wherein said locking means includes two parallel faces pivotally connected adjacent one end to said axial member and separated by a container wall engaging member.

15. The pallet for use with a freight container according to claim 14, wherein the container wall engaging member is an additional axial member located between said two parallel faces about which a roller member is rotatable.

16. A pallet for use with a freight container, comprising:

a chassis;

locomotion means for rolling said chassis into, and out of, a freight container; and, locking means for immobilizing said chassis within the freight container, said locking means including a locking device adjacent existing corners of a trailing edge of said pallet and being engagable with a side of the freight container, said locking device further including a body member welded to said trailing edge of said pallet, said body member housing a screw member screwable outwardly, so that an outer extremity thereof engages a side wall of the freight container.

17. The pallet for use with a freight container according to claim 16, wherein said screw member is engagable with a wall of the freight container via a locking nut mounted on said screw member.

18. A pallet for use with a freight container, comprising:

a chassis;

locomotion means for rolling said chassis into, and out of, a freight container;

at least one roller mounted on each of two opposing sides of said chassis for engaging a vertical container wall or an adjacent pallet; and, a locking mechanism for immobilizing said chassis within the freight container and being positioned at a trailing edge of said chassis, said locking mechanism having an extensible member fixedly extendable at increments from a retracted position to a variable extended position for engaging with a door of the freight container or an adjacent pallet when in an extended position.

19. The pallet for use with a freight container according to claim 18, wherein said locking mechanism includes a ratchet and pawl arrangement for incrementally extending said extensible member.

20. A pallet for use with a freight container, comprising:

a chassis;

locomotion means for rolling said chassis into, and out of, a freight container;

a locking device located on each of two opposite sides of said chassis adjacent corners of a trailing edge of said chassis, said locking device being movable between a retracted position and an extended position for being engagable with a side wall of the freight container or an adjacent pallet; and, a locking mechanism for immobilizing said chassis within the freight container being positioned at a trailing edge of said chassis and having an extensible member fixedly extendable at increments from a retracted position to a variable position for engaging with a door of the freight container or an adjacent pallet when said locking mechanism is in an extended position.

* * * * *